US005145046A

United States Patent [19]

Satoh

[11] Patent Number: 5,145,046

[45] Date of Patent: Sep. 8, 1992

[54] COIN HANDLING MECHANISM FOR VENDING MACHINE

[75] Inventor: Naoto Satoh, Maebashi, Japan

[73] Assignee: Sanden Corporation, Gunma, Japan

[21] Appl. No.: 555,368

[22] Filed: Jul. 20, 1990

Related U.S. Application Data

[63] Continuation of Ser. No. 253,606, Oct. 5, 1988, abandoned.

[30] Foreign Application Priority Data

Oct. 8, 1987 [JP] Japan ..... 62-154180[U]

[51] Int. Cl.[5] ..... G07F 1/04; G07F 3/04

[52] U.S. Cl. ..... 194/203; 194/317

[58] Field of Search ..... 194/203, 317, 318, 319; 453/3, 5, 9, 15, 17

[56] References Cited

U.S. PATENT DOCUMENTS

| | | | |
|---|---|---|---|
| 3,916,922 | 11/1975 | Prümm | 453/3 |
| 4,108,296 | 8/1978 | Hayashi et al. . | |
| 4,220,234 | 9/1980 | Sheltra, Sr. | 453/3 X |
| 4,228,811 | 10/1980 | Tanaka et al. . | |
| 4,234,072 | 11/1980 | Prumm | 194/317 |
| 4,286,703 | 9/1981 | Schuller et al. | 453/9 X |
| 4,298,116 | 11/1981 | Niemeyer | 194/203 |
| 4,625,851 | 12/1986 | Johnson et al. . | |
| 4,625,851 | 12/1986 | Johnson et al. | 194/200 |

FOREIGN PATENT DOCUMENTS

| | | |
|---|---|---|
| 0146251 | 6/1985 | European Pat. Off. . |
| 2636922 | 2/1978 | Fed. Rep. of Germany . |
| 52-043497 | 5/1977 | Japan . |
| 59-40968 | 3/1984 | Japan . |
| 60-044162 | 3/1985 | Japan . |
| 61-237190 | 10/1986 | Japan . |

*Primary Examiner*—F. J. Bartuska

*Attorney, Agent, or Firm*—Banner, Birch, McKie & Beckett

[57] ABSTRACT

A coin handling mechanism for vending machines has a coin validation sensor, a coin accepting gate, a plurality of coin distributing gates and a cutter for cutting a string which is suspending a deposited coin. When a coin suspended by a string is deposited in a coin inlet of the mechanism, the string is caught by the coin accepting gate before the coin reaches the coin distributing gates. When the string is then pulled towards the coin inlet in an attempt to remove the coin, the string is cut by the cutter. The coin with the cut string portion attached thereto then falls down in the machine. In this situation the coin distributing gates are automatically oriented to form a coin path communicating with a cash box therebelow. The coin with the cut string thus falls to the cash box, thereby preventing it from being paid or given to a customer.

27 Claims, 5 Drawing Sheets

COIN HANDLING MECHANISM FOR VENDING MACHINE

This application is a continuation of application Ser. No. 07/253,606, filed Oct. 5, 1988, now abandoned.

BACKGROUND OF THE INVENTION

1. Field of the Invention

The present invention relates to a coin handling mechanism which is used in vending machines and the like, and more particularly to a coin handling mechanism which has a mechanism for preventing theft or mischief such as when the deposited coin is suspended by a string.

2. Description of the Prior Art

The conventional coin handling mechanism for a vending machine, which has means for preventing the mischief of depositing a coin suspended by a string, is constructed, for example, as shown herein in FIG. 5 (Japanese Utility Model Publication SHO 59- 40968). The mechanism has a coin inlet 1, a coin guide path 2 for guiding a deposited coin, coin paths 4*a* and 4*b* connected to the coin guide path, a distributing gate 5 operated by a solenoid 6 and distributing the deposited coin to one of coin paths 4*a* and 4*b*, and a cutter 3 provided in the coin guide path.

In such a mechanism, if a coin 8 suspended by a string 7 is deposited, the string is cut by cutter 3 when the string is pulled upward to retrieve the coin from coin inlet 1. Then, coin 8 with the cut string is sent to a coin retaining tube (not shown) through coin paths 4*a* or 4*b*.

Although the mischief of pulling string 7 and returning coin 8 can be prevented by cutting the string in the mechanism, the coin with the cut attached string can be given to a customer as change because the coin with the cut string is sent to and retained in a coin tube in a change mechanism. The coin with the attached string given to a customer as change gives a bad impression to the customer. Moreover, a hole is often intentionally formed in a coin used for the mischief for the purpose of threading a string through it, and in such a case, the coin is often not commercially acceptable. Furthermore, there is the problem that a coin with a cut string tends to be caught in a coin path or a coin tube if the coin is led into the coin path or the coin tube for coins smaller than the deposited coin.

SUMMARY OF THE INVENTION

Accordingly, an object of the present invention is to provide a coin handling mechanism for a vending machine which can channel a coin with a cut string attached thereto into a cash box, thereby preventing the coin from being paid or given to a customer as change.

To accomplish this object, a coin handling mechanism for a vending machine is herein provided. The mechanism includes a coin validation sensor which tests the authenticity of a deposited coin and detects the type of the deposited coin. A coin accepting gate distributes the deposited coin to either an acceptable coin path or an unacceptable coin path according to the authenticity of the coin as determined by the coin validation sensor. The coin accepting gate closes the acceptable coin path after the period of time needed for an acceptable coin to pass through the coin accepting gate. When the deposited coin is suspended by a suspender such as a string, the coin accepting gate holdes the suspender by the closing action of the coin accepting gate. A cutting means upstream of the coin accepting gate cuts the suspender held by the coin accepting gate. A plurality of coin distributing gates are provided downstream of the coin accepting gate. The coin distributing gates distributes coins accepted by the coin accepting gate to one of a plurality of coin paths provided according to the types of coins to be accepted and a coin path communicating with a cash box. Each of the coin distributing gates operates in the direction, wherein the coin path communicating with the cash box is formed, after the period of time required for an acceptable coin to pass through each distributing gate.

In the coin handling mechanism, a deposited coin determined to be an acceptable coin by the coin validation sensor is accepted to the acceptable coin path by the coin accepting gate. The coin accepting gate immediately shuts after the deposited coin passes through the gate. If the deposited coin is a coin suspended by a suspender, the suspender is held by the closed coin accepting gate, thereby temporarily stopping the further progress of the coin. During this stoppage, the preset time of each coin distributing gate expires, and each coin distributing gate is operated in the direction wherein the coin path communicating with the cash box can be formed. When the suspender being held by the closed coin accepting gate is pulled toward the coin inlet, the suspender is cut by the cutting means and the coin with the cut suspender becomes free. Although the coin with the cut suspender is led downstream of the coin accepting gate, the coin is guided along the coin path communicating with the cash box and sent to the cash box because each coin distributing gate has been already operated in the direction forming the coin path communicating with the cash box.

This operation is performed upon any type of accepted coin suspended by a suspender, and the coin with a cut suspender is consistently sent to the cash box. Accordingly, the coin with the cut suspender attached thereto is never paid or given to a customer as change.

BRIEF DESCRIPTION OF THE DRAWINGS

A preferred exemplary embodiment of the invention will now be described with reference to the accompanying drawings which are given by way of example only, and thus are not intended to limit the present invention, and in which.

DETAILED DESCRIPTION OF THE PREFERRED EMBODIMENT

The preferred embodiment of the present invention will be described hereafter with reference to the attached drawings.

FIGS. 1-3 and 4A-4D illustrate a coin handling mechanism for a vending machine according to an embodiment of the present invention. The coin handling mechanism has on the upper portion thereof a coin inlet 10 into which coins are deposited, a coin chute 11 for guiding the deposited coins and a coin validation sensor 12 which tests the authenticity of the deposited coin and detects or determines the type of the deposited coin.

Figure 1:
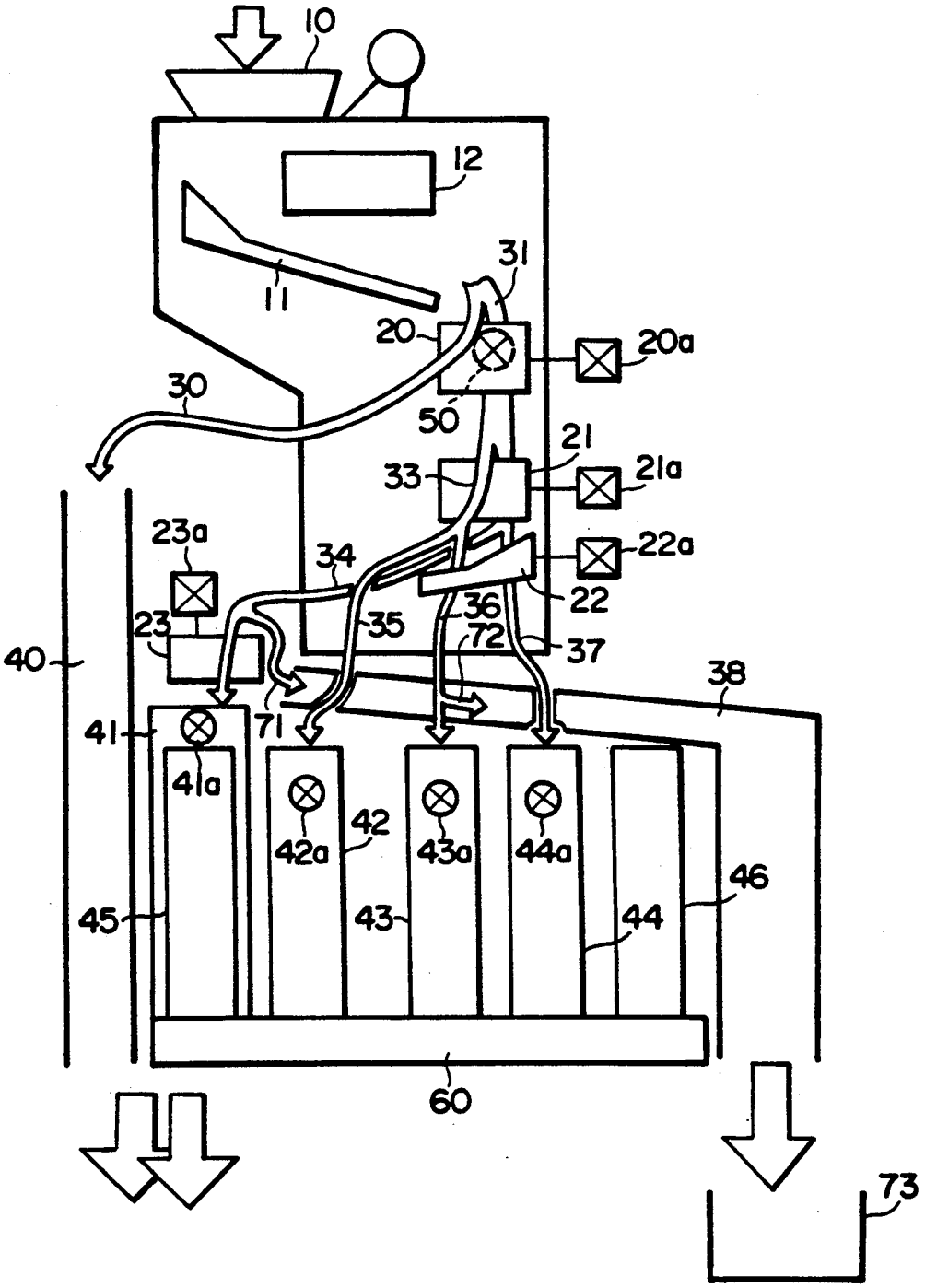
FIG. 1 is a schematic perspective elevational view of a coin handling mechanism according to an embodiment of the present invention.
Figure 2:
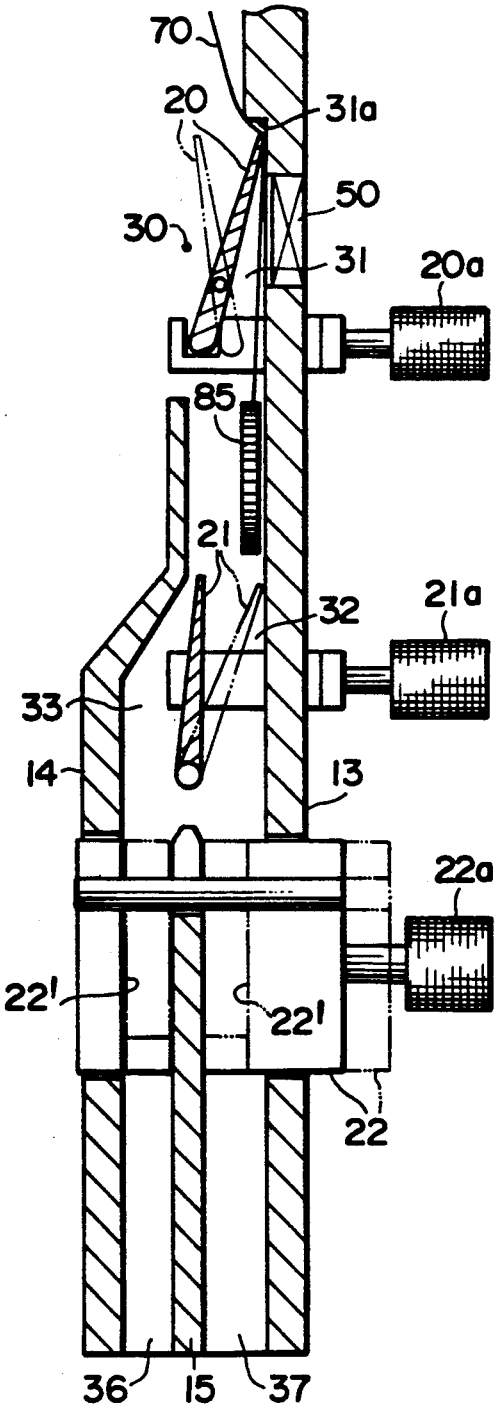
FIG. 2 is an enlarged partial vertical sectional view of the coin handling mechanism shown in FIG. 1.
Figure 5:
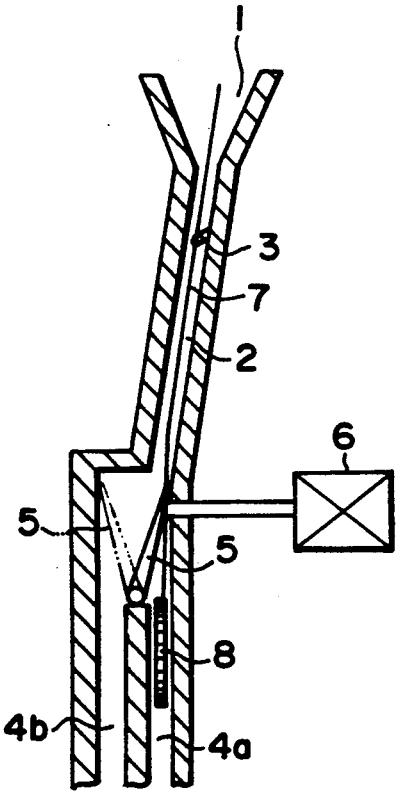
FIG. 5 PRIOR ART
FIG. 5 is a vertical sectional view of a conventional coin handling mechanism.
Figure 3:
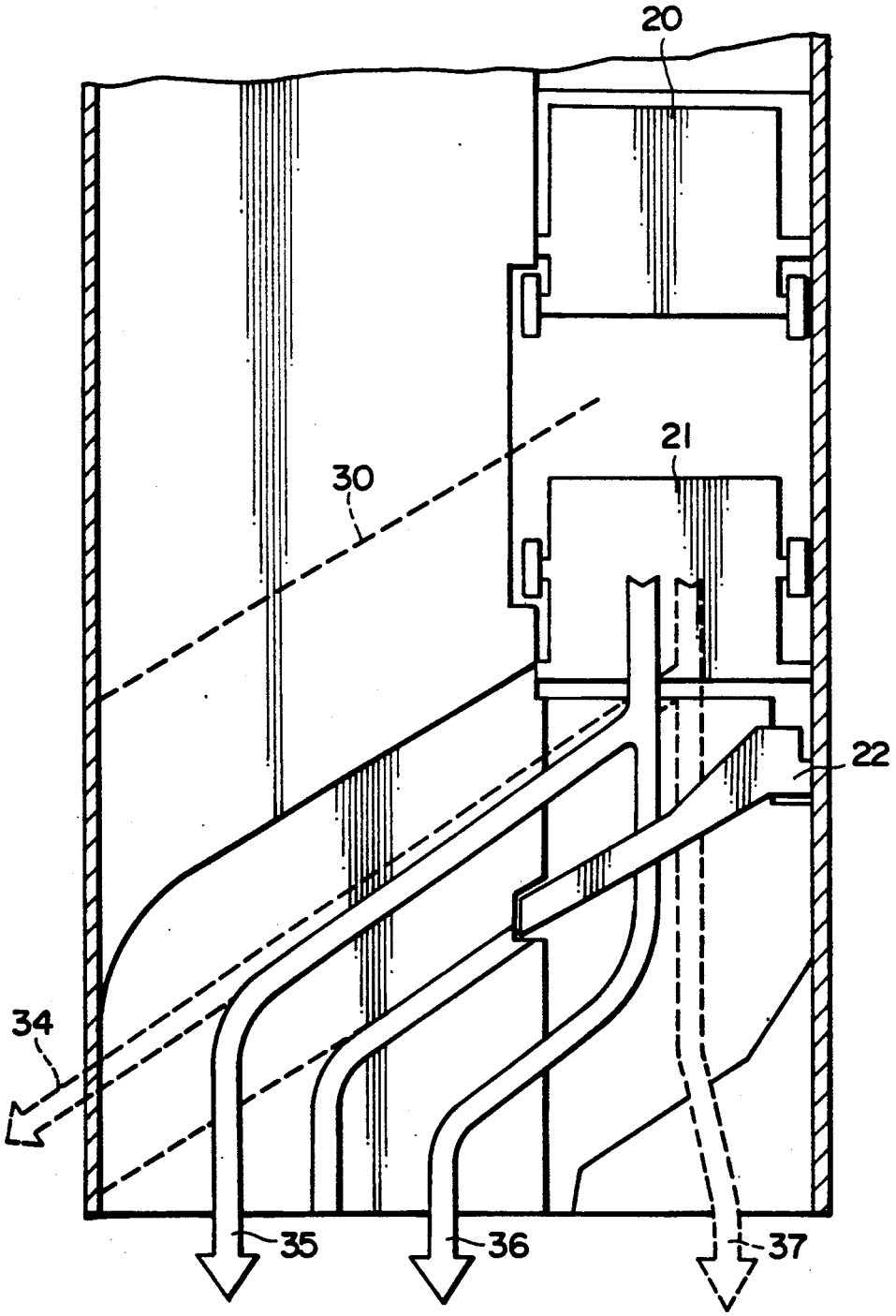
FIG. 3 is an enlarged partial vertical sectional view of the coin handling mechanism shown in FIG. 1, showing coin paths from coin distributing gates.
Figure 4A:
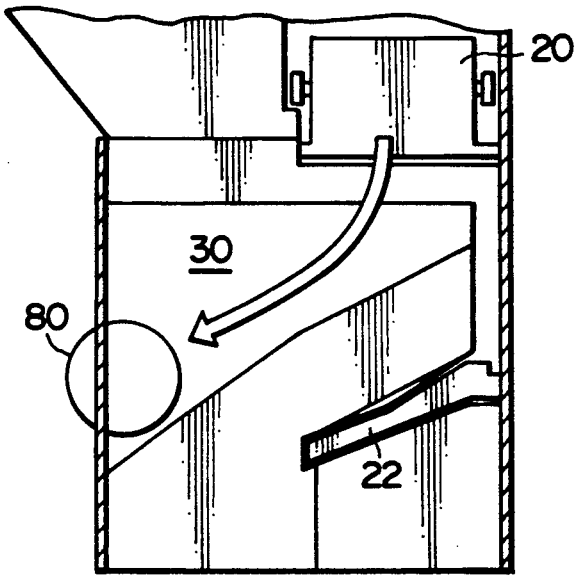
FIG. 4A is an enlarged partial elevational sectional view of the coin handling mechanism shown in FIG. 1, showing the path of an unacceptable coin.
Figure 4B:
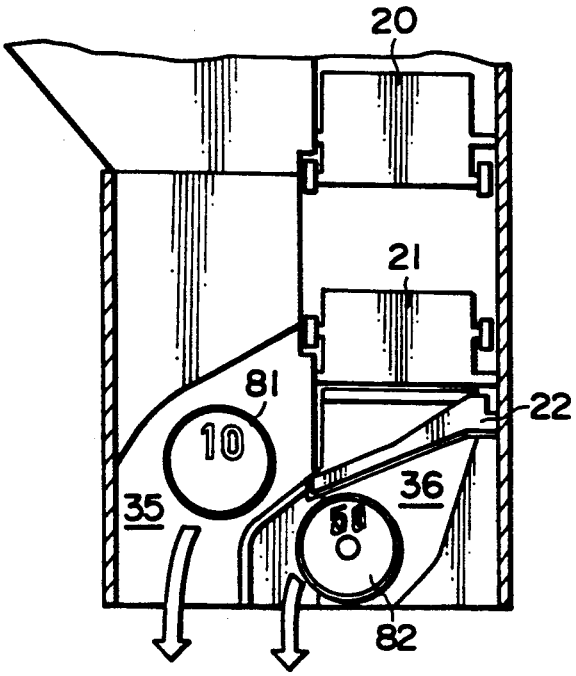
FIG. 4B is an enlarged partial elevational sectional view of the coin handling mechanism shown in FIG. 1, showing the paths of a first coin such as a ten monetary unit (e.g. cents, yen, etc.) coin and a second different coin such as a fifty unit coin.
Figure 4C:
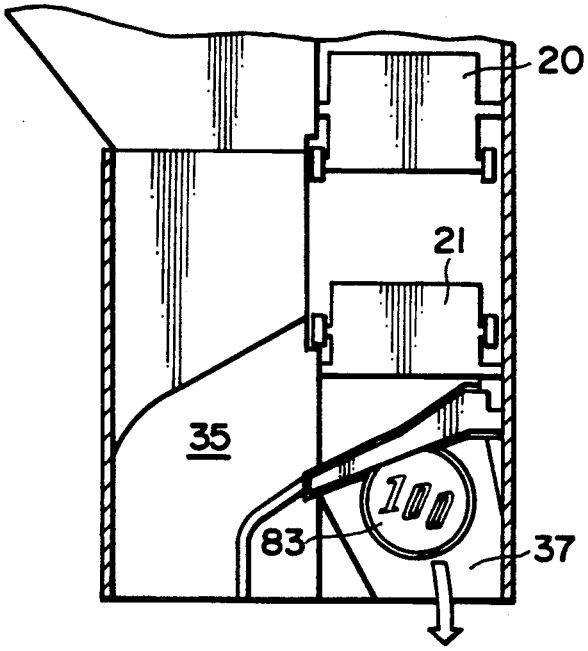
FIG. 4C is an enlarged partial elevational sectional view of the coin handling mechanism shown in FIG. 1, showing the path of a third coin such as a one hundred unit coin.
Figure 4D:
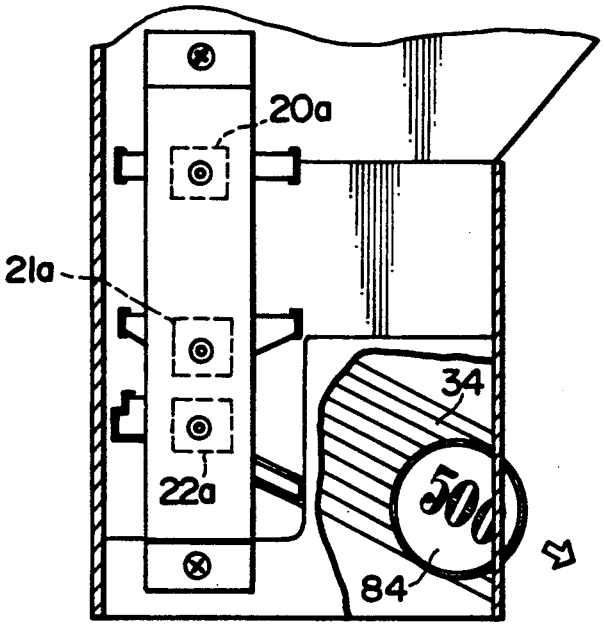
FIG. 4D is an enlarged partial rear-side sectional view of the coin handling mechanism shown in FIG. 1, showing the path of a fourth coin such as a five hundred unit coin.

A coin accepting gate 20 is provided on a portion of the exit side of coin chute 11. Coin accepting gate 20 distributes a deposited coin to either an acceptable coin path 31 or an unacceptable coin path 30 in accordance with the authenticity of the deposited coin tested by coin validation sensor 12. Acceptable coin path 31 is formed between opened coin accepting gate 20 and a base plate 13 as shown in FIG. 2. Unacceptable coin path 30 communicates with a discharge path 40 for unacceptable coins as shown in FIG. 1.

Coin distributing gates 21 and 22 are arranged in the vertical direction downstream of coin accepting gate 20, and another coin distributing gate 23 is positioned downstream of the coin distributing gate 21. As shown in FIG. 2, a cover plate 14 is provided spaced a distance from base plate 13 and a partition 15 is provided between the base plate and the cover plate. Coin distributing gate 21 is positioned above partition 15 and the gate opens one of a coin path 32 for 100 unit (yen) coins and 500 unit coins and a coin path 33 for 10 unit coins and 50 unit coins by the swinging action of the gate. Coin distributing gate 22 has a through hole 22' extending in the vertical direction and the gate opens one of a coin path 36 for 50 unit coins and a coin path 37 for 100 unit coins through the hole by sliding the gate. Coin path 32 communicates directly with a coin path 34 for 500 unit coins and coin path 33 communicates directly with a coin path 35 for 10 unit coins.

Coin path 34 communicates with a coin tube 41 for 500 unit coins, coin path 35 communicates with a coin tube 42 for 10 unit coins, coin path 36 communicates with a coin tube 43 for 50 unit coins and coin path 37 communicates with a coin tube 44 for 100 unit coins. Coin path 34 as a coin path for the largest coins (that is, 500 unit coins) also can communicate a cash box 73 via a coin path 71, which diverges from the coin path 34, and a coin path 38. Therefore, parts of coin path 34, coin path 71 and coin path 34 constitute a coin path communicating with cash box 73. Namely, the part of coin path 34 for 500 unit coins is common to a part of the coin path communicating with cash box 73. Coin distributing gate 23 is disposed on the divergent portion of the common path and the gate distributes a coin led from the common path to either the coin path communicating with coin tube 41 or with coin path 71.

Coin accepting gate 20 and coin distributing gates 21, 22 and 23 are driven by solenoids **20*a*, 21*a*, 22*a* and 23*a*, respectively. Each of solenoids 20*a*, 21*a*, 22*a* and 23*a* is controlled to the "on" or "off" states thereof according to the signal of the authenticity and type of a deposited coin from coin validation sensor 12. When solenoid 20*a* is in its "off" state, coin accepting gate 20 opens unacceptable coin path 30, and when the solenoid is in its "on" state, the gate opens acceptable coin path 31. When solenoid 21*a*is in its "off" state, coin distributing gate 21 opens coin path 32 for 100 unit coins and 500 unit coins, and when the solenoid is in its "on" state, the gate opens coin path 33 for 10 unit coins and 50 unit coins. When solenoid 22*a* is in its "off" state, coin distributing gate 22 opens coin path 36 for 50 unit coins, and when the solenoid is in its "on" state, the gate opens coin path 37 for 100 unit coins. When solenoid 23*a* is in its "off" state, coin distributing gate 23 opens coin path 71 communicating with cash box 73 through coin path 38, and when the solenoid is in its "on" state, the gate opens the coin path communicating with coin tube 41**.

Coin accepting gate 20 is controlled so as to close acceptable coin path 31 immediately following a period of time required for an acceptable coin to pass through the gate, by setting the "on" time of solenoid **20*a* to the above period of time. Similarly, each coin distributing gate 21, 22 or 23 is controlled so as to operate in the direction wherein the coin path communicating with cash box 73 can be formed, immediately following a period of time required for an acceptable coin to pass through the gate, by the operation of each of the corresponding solenoid 21*a*, 22*a* or 23*a*. In this embodiment, all of solenoids 21*a*, 22*a* and 23*a*** turn off after the respective preset periods of time for an acceptable coin to pass through the respective gates.

Moreover, in this embodiment, coin distributing gate 21 is spaced from coin accepting gate 20 so that the coin accepting gate closes acceptable coin path 31 before an acceptable coin which has passed through the coin accepting gate reaches the coin distributing gate.

A stepped wall **31*a* having a sharp edge is formed on base plate 13 at a position upstream of coin accepting gate 20, as a means for cutting a suspender, such as a string 70, which is suspending a coin. Coin accepting gate 20 can hold string 70 by the closing action thereof, in a case in which a deposited coin is suspended by the string, as shown in FIG. 2. Stepped wall 31*a* is constructed so as to cut string 70 when the string is returned toward coin inlet 10. This cutting means may be constructed by a cutter which is provided upstream of coin accepting gate 20**.

In this embodiment, overflow sensors **41*a*, 42*a*, 43*a* and 44*a* are attached on the upper portions of coin tubes 41, 42, 43 and 44, respectively. Each overflow sensor detects whether the corresponding coin tube is filled with coins. Coin paths 34, 71 and 38 communicating with cash box 73 also constitute a coin path for overflow coins in this embodiment. A coin path 72 diverges from coin path 36 for 50 unit coins at a position above coin tube 43. At the divergent portion, a distributing plate (not shown) having a hole or a slit for a coin to be distributed is provided. Coin path 72 is connected to coin path 38 and a 10 unit coin or a 100 unit coin misdirected to coin path 36 can be sent to coin path 38 through coin path 72**.

Further, auxiliary coin tubes 45 and 46 retaining coins for change are provided in the mechanism. Coin tubes 41-44 and auxiliary coin tubes 45 and 46 are connected to a change return mechanism 60 for returning change to the customer. Furthermore, a coin sensor 50, which can detect the passage of an acceptable coin through acceptable coin path 31, is provided on base plate 13 at a position facing coin accepting gate 20. Coin sensor 50 sends the signal of detecting the passage of an acceptable coin to a goods delivering mechanism (not shown) for delivering the required goods to a customer.

In the above coin handling mechanism, a coin deposited into coin inlet 10 is tested for the authenticity and type thereof by coin validation sensor 12 during passage through coin chute 11. Coin accepting gate 20 and coin distributing gates 21, 22 and 23 are controlled according to the signal from coin validation sensor 12 and the signals from overflow sensors 41a–44a. Table 1 shows the modes of operation of the gates 20–23. In Table 1, mark "o" shows the "on" state of a solenoid and mark "x" shows the "off" state of a solenoid.

TABLE 1

| | Unacceptable coin | 500 unit coin | 100 unit coin | 50 unit coin | 10 unit coin | Overflow coin |
|---|---|---|---|---|---|---|
| Gate 20 | x | o | o | o | o | o |
| Gate 21 | x | x | x | o | o | x |
| Gate 22 | x | x | o | x | o | x |
| Gate 23 | x | o | x | x | x | x |
| Coin path | 30 | 34 | 37 | 36 | 35 | 34, 71 38 |
| Coin tube | 40 | 41 | 44 | 43 | 42 | Cash box |

As shown in Table 1, since no distributing gate operates when an unacceptable coin 80 (FIG. 4A) is deposited, the coin is sent to coin path 30 and falls to a coin return opening through discharge path 40. Acceptable coins are distributed as follows. When the deposited coin is a 500 unit coin 84 (FIG. 4D), solenoids 20a and 23a are placed in their "on" states and the coin is led into coin tube 41 through acceptable coin path 31, coin path 32 for 100 unit and 500 unit coins and coin path 34 for 500 unit coins. When the deposited coin is a 100 unit coin 83 (FIG. 4C), solenoids 20a and 22a are placed in their "on" states and the coin is led into coin tube 44 through acceptable coin path 31, coin path 32 and coin path 37 for 100 unit coins. When the deposited coin is a 50 unit coin 82 (FIG. 4B), solenoids 20a and 21a are placed in their "on" states and the coin is led into coin tube 43 through acceptable coin path 31, coin path 33 for 10 unit and 50 unit coins and coin path 36 for 50 unit coins. When the deposited coin is a 10 unit coin 81 (FIG. 4B), solenoids 20a, 21a and 22a are placed in their "on" states and the coin is led into coin tube 42 through acceptable coin path 31, coin path 33 and coin path 35 for 10 unit coins.

When one of coin tubes 41–44 is filled with coins, the corresponding overflow sensor detects this condition and the coin path communicating with the coin tube is switched to the overflow path communicating to cash box 73. In this state, only solenoid 20a is switched on. For instance, when coin tube 42 is filled with 10 unit coins, overflow sensor 42a detects this condition and coin path 35 is switched to coin path 34 as a coin path for overflow 10 unit coins. In this condition, only coin accepting gate 20 opens, and the next 10 unit coin is sent to cash box 73 through coin paths 34, 71 and 38. With other coin tubes 41, 43 and 44, the procedure is similar.

When a deposited coin is a coin 85 suspended by string 70 as shown in FIG. 2, and the coin is an acceptable coin, solenoid 20a turns on and acceptable coin path 31 opens. Although coin 85 enters into and passes through acceptable coin path 31, solenoid 20a turns off and coin accepting gate 20 closes the acceptable coin path immediately after the coin has passed through a position of the gate. At that time, string 70 is caught and held between shut coin accepting gate 20 and base plate 13 as shown in FIG. 2. Coin 85 is suspended by the held string 70 at a position before the coin reaches coin distributing gate 21, and the coin is prevented from progressing further. The preset time for the operation of coin distributing gate 21 then expires, solenoid 21a turns off if it was in its "on" state and it is kept off if it was already in its "off" state. Similarly, each of solenoids 22a and 23a turns off after the preset time required for an acceptable coin to pass through each corresponding gate. In other words, coin distributing gate 21 opens coin path 32, gate 22 closes coin path 37 and gate 23 opens coin path 71. Therefore, a coin path communicating with cash box 73 is formed by coin path 32, coin path 34, coin path 71 and coin path 38.

When string 70, which has been stopped by coin accepting gate 20, is pulled upward, the string is cut by the edge of stepped wall 31a, and coin 85 with a cut string portion attached thereto falls down. At that time, however, since the preset time for solenoid 21a has already expired, coin distributing gate 21 is opening coin path 32. Coin 85 with the cut string falls into coin path 32. When coin 85 reaches coin path 32, coin path 37 is closed because the preset time for solenoid 22a has already expired, and thus coin 85 is led into coin path 34. Similarly, when coin 85 reaches the position of coin distributing gate 23, the preset time for solenoid 23a has already expired. Therefore, coin path 71 is open and coin 85 is sent to cash box 73 through coin paths 71 and 38.

Thus coin 85 with the cut string can be sent into cash box 73. Since a coin with a cut string is not sent to any coin tube, the coin can be prevented from being paid or given to a customer through change return mechanism 60.

Moreover, since a coin with a cut string is sent to cash box 73 through coin path 34 which is for the largest coins (500 unit coins), that is, through a coin path having a large width, the coin can be smoothly sent even though the coin has the cut string attached to it.

Although only one preferred embodiment of the present invention has been described herein in detail, it will be appreciated by those skilled in the art that various modifications and alterations can be made to this embodiment without materially departing from the novel teachings and advantages of this invention. Accordingly, it is to be understood that all such modifications and alterations are included within the scope of the invention as defined by the following claims.

What is claimed is:

1. A coin handling mechanism for vending machines, said mechanism comprising:

holding means for holding a suspender attached to a deposited coin;

cutting means for cutting the suspender being held by said holding means;

a cash box;

a customer change mechanism; and guiding means, associated generally with the time of passage of the suspender and attached deposited coin, including the time the suspended coin is held by said holding means, as compared with the shorter time of passage of a coin without an attached suspender, for selectively guiding a coin with an attached suspender portion cut by said cutting means generally from said holding means along a first coin path to said cash box and a coin without an attached suspender along at least a second coin path to said customer change mechanism.

2. The mechanism of claim 1 wherein said holding means comprises a solenoid-operated coin accepting gate and said guiding means comprises a plurality of solenoid-operated distributing gates.

3. The mechanism of claim 2 wherein the first of said distributing gates is spaced downstream from said coin accepting gate such that said coin accepting gate closes before an acceptable coin passing therethrough reaches said first distributing gate.

4. The mechanism of claim 1 wherein said at least a second coin path comprises a third coin path at least a portion of which is common with a portion of said first coin path and thereby defining a common path.

5. The mechanism of claim 4 wherein said common path includes a divergent portion and said guiding means includes a distributing gate on said divergent portion.

6. The mechanism of claim 4 wherein said common path comprises the coin path for the largest acceptable coins of said customer change mechanism.

7. The mechanism of claim 1 wherein said cutting means comprises a stepped wall having a sharp cutting edge.

8. The mechanism of claim 1 wherein said customer change mechanism includes a plurality of coin retaining tubes and said at least a second coin path comprises a plurality of coin paths each communicating with a separate said coin retaining tube.

9. The mechanism of claim 1 wherein said cutting means is disposed upstream of aid holding means.

10. The mechanism of claim 1 further comprising coin validation sensing means upstream of said guiding means for testing the authenticity of and determining the type of the deposited coin.

11. The mechanism of claim 1 wherein said cash box is separate from the customer change mechanism such that the coins with attached suspender portions guided to said cash box are prevented from being given to a customer.

12. The mechanism of claim 3 wherein each of said plurality of distributing gates closes immediately after a predetermined time period, the predetermined time period being that required for an acceptable coin passing through one of said coin accepting gate and a previous coin distributing gate to pass therethrough.

13. A coin handling mechanism for vending machines, said mechanism comprising:

detecting means for detecting whether deposited items are acceptable coins or unacceptable items and distributing the acceptable coins including those with attached suspenders to an acceptable coin path and the unacceptable items to an unacceptable coin path;

cutting means for cutting the suspender of an acceptable coin with a suspender attached thereto; and separating means for separating an acceptable coin without an attached suspender from an acceptable coin with an attached suspender cut by said cutting means and guiding the acceptable coin without an attached suspender from said acceptable coin path to a customer change mechanism and the acceptable coin with an attached cut suspender from said acceptable coin path to a cash box;

wherein said detecting means includes a coin accepting gate which opens to allow an acceptable coin to pas to said acceptable coin path;

wherein said separating means includes a plurality of coin distributing gates for distributing acceptable coins without cut attached suspenders according to the type of coin to a plurality of acceptable coin tracks associated therewith and communicating with the respective coin tubes of the customer change mechanism; and wherein each of said plurality of distributing gates closes immediately after a predetermined time period, the predetermined time period being that required for an acceptable coin passing through one of said coin accepting gate and a previous coin distributing gate to pass therethrough.

14. The mechanism of claim 13 wherein said coin accepting gate closes after a time just sufficient for an acceptable coin to pass therethrough and thereby closing on a suspender attached to an acceptable coin.

15. The mechanism of claim 14 wherein said cutting means cuts the attached suspender as it is being held by said coin accepting gate when closed thereon.

16. The mechanism of claim 13 wherein said cutting means is positioned upstream of said coin accepting gate.

17. The mechanism of claim 13 wherein said separating means guides the acceptable coins with attached suspenders along a customer change mechanism track to the customer change mechanism, said customer change mechanism track being coincident with a portion of one of said acceptable coin tracks and thereby defining a common path.

18. The mechanism of claim 17 wherein said common path has a divergent portion and one of said coin distributing gates is on said divergent portion.

19. The mechanism of claim 13 wherein said cutting means comprises a stepped wall having a sharp cutting edge.

20. The mechanism of claim 13 wherein said detecting means comprises a solenoid-operated coin accepting gate and said separating means comprises a plurality of solenoid-operated coin distributing gates.

21. The mechanism of claim 13 wherein said cutting means cuts the suspender when the acceptable coin is in said acceptable coin path.

22. The mechanism of claim 13 wherein said cash box is separate from said customer change mechanism such that the acceptable coins with attached cut suspenders delivered to said cash box are prevented from being given to a customer.

23. The mechanism of claim 20 wherein a first of said distributing gates is spaced downstream from said coin accepting gate such that said coin accepting gate closes before an acceptable coin passing therethrough reaches said first distributing gate.

24. The mechanism of claim 23 wherein each of said plurality of distributing gates closes immediately after a predetermined time period, the predetermined time period being that required for an acceptable coin passing through one of said coin accepting gate and a previous coin distributing gate to pass therethrough.

25. A coin handling mechanism for vending machines, said mechanism comprising:

customer change means for returning deposited coins flowing thereto to customers as change;

a cash box separate from said customer change means so that coins flowing thereto are prevented from being returned to a customer as change;

directing means for directing acceptable deposited coins to an acceptable coin path and unacceptable deposited coins to a different, unacceptable coin path;

cutting means for cutting suspenders attached to acceptable coins; and gate means for defining relative to the acceptable coin path a first coin path generally from said directing means for acceptable coins without attached cut suspender portions to said customer change mechanism and, after the period of time required for the acceptable coins without attached cut suspender portions to pass from said directing means along the fist coin path, a second coin path generally from said directing means for acceptable coins with attached cut suspender portions to said cash box.

26. The mechanism of claim 25 wherein said directing means comprises a coin validation sensor and a coin accepting gate operatively connected to said coin validation sensor.

27. The mechanism of claim 26 wherein said coin accepting gate holds the suspender as said cutting means cuts it.

* * * * *